US005558802A

United States Patent [19]

Dowling

[11] Patent Number: 5,558,802

[45] Date of Patent: Sep. 24, 1996

[54] MULTIGRADE CRANKCASE LUBRICANTS WITH LOW TEMPERATURE PUMPABILITY AND LOW VOLATILITY

[75] Inventor: Michael Dowling, Streatley, United Kingdom

[73] Assignee: Exxon Chemical Patents Inc, Linden, N.J.

[21] Appl. No.: 528,446

[22] Filed: Sep. 14, 1995

[51] Int. Cl.[6] ..... C10M 159/20

[52] U.S. Cl. ..... 508/391; 508/518; 508/586

[58] Field of Search ..... 252/39, 18; 585/10

[56] References Cited

U.S. PATENT DOCUMENTS

| | | | |
|---|---|---|---|
| 2,719,125 | 9/1955 | Roberts | 252/46.7 |
| 2,719,126 | 9/1955 | Fields et al. | 252/47 |
| 3,087,932 | 4/1963 | Little, Jr. | 260/302 |
| 3,087,936 | 4/1963 | LeSuer | 260/326.3 |
| 3,254,025 | 5/1966 | LeSuer | 252/32.7 |
| 3,275,554 | 9/1966 | Wagenaar | 252/50 |
| 3,381,022 | 4/1968 | LeSuer | 260/404.8 |
| 3,442,808 | 5/1969 | Traise et al. | 252/49.6 |
| 3,565,804 | 2/1971 | Honnen | 252/50 |
| 3,821,236 | 6/1974 | Ripple | 260/302 |
| 3,904,537 | 9/1975 | Ripple | 252/47.5 |
| 4,097,387 | 6/1978 | Caspari | 252/47.5 |
| 4,102,798 | 7/1978 | Ryer et al. | 252/51.5 A |
| 4,107,059 | 8/1978 | King et al. | 252/28 |
| 4,113,639 | 9/1978 | Lonstrup et al. | 252/51.5 A |
| 4,116,876 | 9/1978 | Brois et al. | 252/49.6 |
| 4,136,043 | 1/1979 | Davis | 252/47.5 |
| 4,188,299 | 2/1980 | Caspari | 252/46.4 |
| 4,193,882 | 3/1980 | Gemmill, Jr. | 252/47.5 |
| 4,234,435 | 11/1980 | Meinhardt et al. | 252/51.5 A |
| 4,530,914 | 7/1985 | Ewen et al. | 502/113 |
| 4,665,208 | 5/1987 | Welborn, Jr. et al. | 556/179 |
| 4,702,850 | 10/1987 | Gutierrez et al. | 252/48.2 |
| 4,808,561 | 2/1989 | Welborn, Jr. | 502/104 |
| 4,857,217 | 8/1989 | Gutierrez et al. | 252/47 |
| 4,871,705 | 10/1989 | Hoel | 502/117 |
| 4,897,455 | 1/1990 | Welborn, Jr. | 526/129 |
| 4,935,576 | 6/1990 | Chen | 585/522 |
| 4,937,299 | 6/1990 | Ewen et al. | 526/119 |
| 4,938,880 | 7/1990 | Waddoups et al. | 252/32.7 E |
| 4,950,822 | 8/1990 | Dileo et al. | 585/310 |
| 4,952,716 | 8/1990 | Lukac et al. | 556/482 |
| 4,952,739 | 8/1990 | Chen | 585/18 |
| 4,956,107 | 9/1990 | Gutierrez et al. | 252/47 |
| 4,963,275 | 10/1990 | Gutierrez et al. | 252/47 |
| 4,982,045 | 1/1991 | Chen et al. | 585/532 |
| 5,012,020 | 4/1991 | Jackson et al. | 585/10 |
| 5,017,714 | 5/1991 | Welborn, Jr. | 556/12 |
| 5,053,152 | 10/1991 | Steckel | 252/51.5 R |
| 5,055,438 | 10/1991 | Canich | 502/117 |
| 5,057,475 | 10/1991 | Canich et al. | 502/104 |
| 5,064,802 | 11/1991 | Stevens et al. | 502/155 |
| 5,096,867 | 3/1992 | Canich | 502/103 |
| 5,120,867 | 6/1992 | Welborn, Jr. | 556/12 |
| 5,124,418 | 6/1992 | Welborn, Jr. | 526/114 |
| 5,146,021 | 9/1992 | Jackson et al. | 585/10 |
| 5,153,157 | 10/1992 | Hlatky | 502/117 |
| 5,157,177 | 10/1992 | Pelrine et al. | 585/10 |
| 5,198,401 | 3/1993 | Turner et al. | 502/155 |
| 5,227,440 | 7/1993 | Canich et al. | 526/129 |
| 5,229,022 | 7/1993 | Song et al. | 252/56 R |
| 5,241,025 | 8/1993 | Hlatky et al. | 526/129 |
| 5,290,464 | 3/1994 | Fisicaro et al. | 252/52 R |
| 5,436,379 | 7/1995 | Heilman et al. | 585/10 |
| 5,466,364 | 11/1995 | Kaul et al. | 208/307 |

FOREIGN PATENT DOCUMENTS

| | | |
|---|---|---|
| 0208560 | 1/1987 | European Pat. Off. . |
| 0277004 | 8/1988 | European Pat. Off. . |
| 0277003 | 8/1988 | European Pat. Off. . |
| 0330522 | 6/1989 | European Pat. Off. . |
| 0129368 | 7/1989 | European Pat. Off. . |
| 0420436 | 4/1991 | European Pat. Off. . |
| 0490454 | 6/1992 | European Pat. Off. . |
| 0520732 | 12/1992 | European Pat. Off. . |
| 989409 | 4/1965 | United Kingdom . |
| 2001662 | 2/1979 | United Kingdom . |
| 1560830 | 2/1980 | United Kingdom . |
| 91/04257 | 4/1991 | WIPO . |
| 92/00333 | 1/1992 | WIPO . |
| 93/08199 | 4/1993 | WIPO . |
| 93/08221 | 4/1993 | WIPO . |
| 94/07928 | 4/1994 | WIPO . |
| 94/13715 | 6/1994 | WIPO . |

OTHER PUBLICATIONS

W. W. Yau, J. J. Kirkland and D. D. Bly, "Modern Size Exclusion Liquid Chromatography" John Wiley and Sons, New York, 1979 month unavailable.

M. Belzer "Journal of Tribology" (1992), vol. 114, pp. 675–682 month unavailable.

M. Belzer and S. Jahanmir in "Lubrication Science" (1988), vol. 1, pp. 3–26 month unavailable.

The American Petroleum Institute—Publication 1509 "Engine Oil Licensing and Certification System" Jan. 1993, Appendix E, 1.2.

*Primary Examiner*—Jacqueline V. Howard

*Attorney, Agent, or Firm*—Mary M. Allen

[57] ABSTRACT

The detergent inhibitor package has been found to influence the viscometric properties of SAE 5W lubricants that have less than 5 mass % of non-conventional basestock, use a basestock that has an average base stock neutral number not less than 105, a calibrated Noack volatility of not more than 22 wt. % loss, and a kinematic viscosity at 100° C. (kV 100, measured by ASTM D445) less than 12.5 cSt. In particular, neutral and overbased calcium salts of organic acids have been found to increase low temperature high shear viscosity when measured in the CCS (ASTM D5293). These salts which are widely used for their detergency and acid neutralization properties should be avoided altogether or used at a level not exceeding 0.0007 moles of organic calcium salt per 100 grams of lubricant. Where diesel performance is required, for example to lubricate passenger car diesel engines, a calcium salt of an organic acid may be required to control piston deposits. In that circumstance the level of calcium salt should be kept between 0.0004 and 0.0007 moles per 100 grams of lubricant.

9 Claims, No Drawings

MULTIGRADE CRANKCASE LUBRICANTS WITH LOW TEMPERATURE PUMPABILITY AND LOW VOLATILITY

FIELD OF THE INVENTION

The present invention relates to multigrade crankcase lubricants that have good low temperature pumpability and low volatility. More particularly the present invention relates to SAE 5W multigrade lubricants that have less than 5 mass % of non-conventional basestock, use a basestock having an average basestock neutral number not less than 105 for a 5W multigrade and have a kinematic viscosity at 100° C. (kV 100, measured by ASTM D445) less than 12.5 cSt.

BACKGROUND OF THE INVENTION

Crankcase lubricants comprise basestock and additives that delay degradation of the basestock and improve its performance. Such additives typically include dispersant, overbased and neutral salts of organic acids, corrosion inhibitors, antiwear agents, antioxidants, friction modifiers, antifoamants, and demulsifiers. These additives may be combined in a package, sometimes referred to as a detergent inhibitor (or DI) package. The additives in such a package may include functionalized polymers, but these have relatively short chains, typically having a number average molecular weight $\overline{M}n$ of not more than 7000.

Multigrade lubricants perform over wide temperature ranges. Typically, they are identified by two numbers such as 10W-30 or 5W-30. The first number in the multigrade designation is associated with a safe cranking temperature (e.g., −20° C.) viscosity requirement for that multigrade oil as measured by a cold cranking simulator (CCS) under high shear rates (ASTM D5293). In general, lubricants that have low CCS viscosities allow the engine to crank more easily at lower temperatures and thus improve engine startability at those ambient temperatures.

The second number in the multigrade designation is associated with a lubricant's viscosity under normal operating temperatures and is measured in terms of the kinematic viscosity (kV) at 100° C. (ASTM D445). The high temperature viscosity requirement brackets minimum and maximum kinematic viscosity at 100° C. Viscosity at high temperatures is desirable to prevent engine wear that would result if the lubricant thinned out too much during engine operation. However the lubricant should not be too viscous because excessive viscosity may cause unnecessary viscous drag and work to pump the lubricant which in turn can increase fuel consumption. In general, the lower a lubricants' kV 100° C., the better the scores that lubricant achieves in fuel economy tests.

Thus, in order to qualify for a given multigrade oil designation a particular multigrade oil must simultaneously meet both strict low and high temperature viscosity requirements that are set by SAE specifications such as SAE J300. The current viscosity limits set in SAE J300 are as follows:

| | SAE VISCOSITY GRADES | | |
|---|---|---|---|
| SAE viscosity grade | Maximum CCS Viscosity $10^{-3}$ Pa.s @ (°C.) | kV 100° C. $mm^2/s$ minimum | kV 100° C. $mm^2/s$ maximum |
| 0W | 3250 (−30) | 3.8 | — |
| 5W | 3500 (−25) | 3.8 | — |
| 10W | 3500 (−20) | 4.1 | — |

-continued

| | SAE VISCOSITY GRADES | | |
|---|---|---|---|
| SAE viscosity grade | Maximum CCS Viscosity $10^{-3}$ Pa.s @ (°C.) | kV 100° C. $mm^2/s$ minimum | kV 100° C. $mm^2/s$ maximum |
| 15W | 3500 (−15) | 5.6 | — |
| 20W | 4500 (−10) | 5.6 | — |
| 25W | 6000 (−5) | 9.3 | — |
| 20 | — | 5.6 | <9.3 |
| 30 | — | 9.3 | <12.5 |
| 40 | — | 12.5 | <16.3 |
| 50 | — | 16.3 | <21.9 |
| 60 | — | 21.9 | <26.1 |

In the SAE J300 scheme multigrade oils meet the requirements of both low temperature and high temperature performance. For example, an SAE 5W-30 multigrade oil has viscosity characteristics that satisfy both the 5W and the 30 viscosity grade requirements—i.e., a maximum CCS viscosity of $3500\times10^{-3}$ Pa.s at −25° C., a minimum kV100° C. of 9.3 $mm^2/s$ and a maximum kV100° C. of <12.5 $mm^2/s$.

Presently, the viscosity characteristics of a lubricant are thought to depend primarily on the viscosity characteristics of the basestock and on the viscosity characteristics of the viscosity modifier. Of the other additives often found in lubricants only high molecular weight dispersants have been thought to influence viscometrics, and their influence has been deemed small in comparison to basestock and viscosity modifier.

The viscosity characteristic of a basestock on which a lubricating oil is based is typically expressed by the neutral number of the oil (e.g., S150N) with a higher neutral number being associated with a higher viscosity at a given temperature. This number is defined as the viscosity of the basestock at 40° C. measured in Saybolt Universal Seconds. Blending basestocks is one way of modifying the viscosity properties of the resulting lubricating oil. For example a lubricant formulated entirely with S100N will have both a lower kV 100 and a lower CCS than a lubricant formulated entirely with a S150N basestock. A basestock comprised of a blend of S100N and S150N will have a CCS in between those of the straight cuts. The average basestock neutral number (ave. BSNN) of a blend of straight cuts may be determined according to the following formula:

$$\log(\text{ave. } BSNN) = \left[ BSR1 \times \log \frac{BSNN1}{100} \right] + \left[ BSR2 \times \log \frac{BSNN2}{100} \right] + \ldots \left[ BSRn \times \log \frac{BSNNn}{100} \right]$$

where $BSRn$ = basestock ratio for basestock $n$
= (wt. % basestock $n$/wt. % total basestock in oil) × 100%

$BSNNn$ = basestock neutral number for basestock $n$

Merely blending basestocks of different viscosity characteristics may not enable the formulator to meet the low and high temperature viscosity requirements of some multigrade oils. The formulator's primary tool for achieving this goal is an additive conventionally referred to as a viscosity modifier or viscosity index (V.I.) improver. Usually, to reach the minimum high temperature viscosity required, it is necessary to add significant amounts of viscosity modifier which in turn results in increased low temperature viscosity. The ever increasing need to formulate crankcase lubricants that deliver improved performance in fuel economy tests is driving the industry to lubricants in the lower viscosity grades, that is 5W30, 5W20, and lower.

When the lubricant is a wide grade, e.g., 5W20 or 5W30, large amounts of viscosity modifier are nonetheless required. In these lubricants it is usual to reduce the basestock viscosity by blending in less viscous oils—i.e., to lower the average neutral number of the total basestock. If conventional mineral basestocks are used, it is usual to replace some or all of a higher viscosity basestock such as S150N basestock with a basestock of S100N or less to improve CCS performance in wide multigrades.

An alternative means of reducing the basestock viscosity and therefore improving CCS performance is to employ so-called non-conventional lubricants (or NCL). The American Petroleum Institute (API) in its Publication 1509 dated January 1993 entitled "Engine Oil Licensing and Certification System" (EOLCS) in Appendix E, 1.2 provided a classification of basestocks in a number of categories, which are widely used in the lubricant industry. Conventional mineral basestocks are in Groups 1 and 2; NCLs are basestocks that do not fall within those two Groups. Examples of NCLs are synthetic basestocks such as polyalphaolefin oligomers (PAO) and diesters and specially processed mineral basestocks such as basestocks that have been hydrocracked or hydroisomerised to give greater paraffinic content and lower aromatic content. These NCLs result in a smaller increase in volatility but are available only in limited quantities, are very expensive, and may not respond well to conventional antioxidant systems.

At the same time that fuel economy test performance is becoming more important, a need to reduce volatility of the lubricant has been identified. Oil volatility has been associated in the technical literature with both oil consumption and exhaust emissions both of which are undesirable. The two most significant factors influencing volatility are the solvent neutral number and viscosity index of the basestock. Basestocks with lower viscosity or low viscosity index are rich in more volatile components. One method used to measure volatility of a lubricant is the Noack method. Two standardized Noack methods are JPI Method 5S-41-93 and CEC Noak L- 40-T-87. Those methods measure the percent mass lost in a sample after it has been held for a period of 60 minutes at 250° C. with air being pulled through the sample. The official methods have good within lab repeatability and at this time poorer lab-to-lab reproducibility. Accordingly, for purposes of this invention all Noack measurements are to be made in instruments that have been calibrated with a reference fluid. The instrument should correlate within 6 wt. % to the weight loss observed for a reference fluid of known Noack volatility. One such reference fluid is reference lubricant RF 172 available from CEC, Brussels, Belgium and from Petrolab, Latham, N.Y. An oil is satisfactory if it yields a calibrated Noack volatility of not greater than 22 wt. % loss in an instrument that has been calibrated with fluids having standard volatilities.

Thus, the need for improved performance in fuel economy tests drives the blender to use basestock with lower solvent neutral numbers, while the need to reduce volatility drives the blender to use basestocks with higher solvent neutral numbers. The issue becomes particularly acute for lubricants in SAE J300 grades of 5W-30, 5W-20. To meet volatility requirements, lubricants of those grades are usually blended with basestocks having an average solvent neutral number of at least S105N.

SUMMARY OF THE INVENTION

Surprisingly, the make-up of the detergent inhibitor package has been found to influence the viscometric properties of SAE 5W lubricants that have less than 5 mass % of non-conventional lubricant basestock, use a basestock that has an average basestock neutral number not less than 105, a calibrated Noack volatility of not more than 22 wt. % loss, and a kinematic viscosity at 100° C. (kV 100, measured by ASTM D445)less than 12.5 cSt. In particular, neutral and overbased calcium salts of organic acids have been found to increase low temperature high shear viscosity when measured in the CCS (ASTM D5293). These salts which are widely used for their detergency and acid neutralization properties should be avoided altogether or used at a level not exceeding 0.0007 moles of calcium salt per 100 grams of lubricant. Where diesel performance is required, for example to lubricate passenger car diesel engines, a calcium salt of an organic acid may be required to control piston deposits. In that circumstance the level of calcium salt should be kept between 0.0004 and 0.0007 moles per 100 grams of lubricant.

Calcium salts of organic acids typically used are the oil-soluble neutral and overbased sulfonates, phenates, sulfurized phenates, thiophosphonates, salicylates, and naphthenates and other oil-soluble carboxylates of calcium. These compounds are present as stable colloidal dispersions of salt in oil. The components are generally made by neutralizing the organic acid with a strong calcium base in the presence of process aids. When the component is overbased, the organic acid is neutralized with a strong calcium base in the presence of an acidic gas (often carbon dioxide). In consequence both the organic acid and the acidic gas are converted to the calcium salt and the component contains metal in an amount in excess of that required to neutralize the organic acid.

Manufacture of these components is extremely complex and the final composition of the colloidal dispersion is not known with accuracy. For example sulfurized metal phenates are generally described as bis-thiophenates with sulfur linkages of varying lengths. In fact the number of phenolic groups actually linked together is not known with certainty. Similarly, the amount of phenol assumed to convert to a metal salt is often assumed to be 100%. In fact the degree of the neutralization depends on the acidity of the phenol and the acidity of the neutralizing base. Further the equilibria established when the component is made shift whenever the component is blended with other materials containing strong bases. For these reasons, the amounts of carbonate, sulfonate, and phenolic hydroxide present in a lubricant are inferred from the amounts present in the individual components that are blended to make the finished lubricant. And those amounts are in turn inferred from the charge ratios of raw materials used to make the detergents or by resort to analytical methods that can determine detectable moieties allowing inference of the remaining moieties.

Thus the moles of calcium salt of an organic acid present can be determined directly in some cases and in others must be derived. When the salt is a calcium sulfonate, direct analysis is possible using the liquid chromatography method described in ASTM 3712. For other organic acids, the moles of salt must be derived. When this is required titrimetry including two phase titrimetric methods, total acid number (TAN) as determined using ASTM D664, dialysis and other well known analytical techniques allow determination of the organic salt content. Thus for phenates and carboxylates (including salicylates) the total amount of metal must be determined and allocated between organic and inorganic acids using a metal ratio. The total amount of calcium present is conveniently determined by inductively coupled plasma atomic emission spectrometry—ASTM D4951.

Metal ratio is defined as the total amount of metal present divided by the amount of metal in excess of that required to neutralize any organic acid present, i.e., the amount of metal neutralizing inorganic acids. Metal ratios are quoted by manufacturers of commercial detergents and can be determined by a manufacturer having knowledge of the total amount of salts present and the average molecular weight of the organic acid. The amount of metal salt present in a detergent may be determined by dialyzing the detergent and quantifying the amount of the residue. If the average molecular weight of the organic salts is not known, the residue from the dialyzed detergent can be treated with strong acid to convert the salt to its acid form, analyzed by chromatographic methods, proton NMR, and mass spectroscopy and correlated to acids of known properties. More particularly, the detergent is dialysed and then residue is treated with strong acid to convert any salts to their respective acid form. The hydroxide number of the mixture can then be measured by the method described in ASTM D1957. If the detergent contains non-phenolic hydroxyl groups on the phenolic compound (e.g., alcoholic derivatives of ethylene glycol used in manufacture of commercial phenates or carboxylic acid groups on salicylic acid), separate analyses must be conducted to quantify the amounts of those hydroxyl groups so that the hydroxide number determined by ASTM D1957 can be corrected. Suitable techniques to determine the quantity of non-phenolic hydroxyl groups include analyses by mass spectroscopy, liquid chromatography, and proton NMR and correlation to compounds having known properties.

A second method for deriving the number of moles of calcium salt of an organic acid present assumes that all of the organic acid charged to make the component is in fact converted to the salt. When the lubricant contains more than one calcium salt of amounts of individual salts are added together to reach a total amount of calcium salt. In practice the two methods can give slightly different results, but both are believed to be sufficiently precise to allow determination of the amount of salt present to the precision required to practice the present invention.

When diesel performance is required, a calcium salt, especially a calcium phenate may be helpful to prevent piston deposits. In this situation, at least 0.0004 moles of calcium salt should be used.

DETAILED DESCRIPTION OF THE INVENTION

A. BASESTOCK

The basestock used in the lubricating oil may be selected from any of the natural mineral oils of API Groups 1 and 2 (EOLCS, Appendix E, 1.2) used in crankcase lubricating oils for spark-ignited and compression-ignited engines. The basestock is selected within the constraints of the invention. Mineral basestocks are typically available with a viscosity of from 2.5 to 12 $mm^2/s$, more usually from 2.5 to 9 $mm^2/s$ at 100° C. A particular advantage of the present invention is that acceptable volatility levels may be achieved by blending high viscosity mineral basestocks with low viscosity mineral basestocks to achieve an average solvent neutral number of at least 105. Resort to extremely expensive non-conventional basestocks is unnecessary. The basestock conveniently has a viscosity between about 3 and about 7.5 $mm^2$sec and a viscosity index in the range about 90 to about 100. If the basestock is prepared from straight cuts as opposed to blends, the viscosity is conveniently between about 3.9 and about 5.5 $mm^2$ sec and a viscosity index is in the range about 90 to about 100. If the viscosity index of the basestock is greater than 100, the viscosity is conveniently between about 4.1 and about 5.5 $mm^2$sec.

B. CALCIUM SALT OF AN ORGANIC ACID

Calcium containing and ash-forming detergents function both as detergents to reduce or remove deposits and as acid neutralizers or rust inhibitors, thereby reducing wear and corrosion and extending engine life. In general these detergents comprise a polar head with a long hydrophobic tail, with the polar head comprising a calcium salt of an acidic organic compound. The salts may contain a substantially stoichiometric amount of the metal in which case they are usually described as normal or neutral salts, and would typically have a total base number or TBN (as may be measured by ASTM D2896) of from 0 to 80. It is possible to include large amounts of a metal base by reacting an excess of a metal compound such as an oxide or hydroxide with an acidic gas such as carbon dioxide. The resulting overbased detergent comprises neutralized organic acid as the outer layer of an inorganic metal base (e.g., carbonate) micelle. Such overbased detergents may have a TBN of 150 or greater, and typically of from 250 to 450 or more.

Calcium detergents to be used in carefully controlled amounts include oil-soluble neutral and overbased sulfonates, phenates, sulfurized phenates, thiophosphonates, salicylates, and naphthenates and other oil-soluble carboxylates of calcium. Particularly convenient calcium detergents are neutral and overbased calcium sulfonates having TBN of from 20 to 450 TBN, neutral and overbased calcium phenates and sulfurized phenates having TBN of from 50 to 450, and neutral and overbased calcium salicylates having a TBN of from about 50 to about 450.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt. % (preferably at least 125 wt. %) of that stoichiometrically required.

Metal salts of phenols and sulfurised phenols are prepared by reaction with an appropriate metal compound such as an oxide or hydroxide and neutral or overbased products may be obtained by methods well known in the art. Sulfurised phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Metal salts of carboxylic acids (including salicylic acids) may be prepared in a number of ways: for example, by adding a basic metal compound to a reaction mixture comprising the carboxylic acid (which may be part of a mixture with another organic acid such as a sulfonic acid) or its metal salt and promoter, and removing free water from the reaction mixture to form an metal salt, then adding more basic metal compound to the reaction mixture and removing free water from the reaction mixture. The carboxylate is then overbased by introducing the acidic material such as carbon dioxide to the reaction mixture while removing water. This can be repeated until a product of the desired TBN is obtained.

While the carboxylic acids from which metal overbased salts may be prepared include aliphatic, and cycloaliphatic mono- and polybasic carboxylic acids, for the present invention any calcium carboxylate is preferably a calcium salicylate.

C. VISCOSITY MODIFIERS

The viscosity modifier functions to impart high and low temperature operability to a lubricating oil. The viscosity modifier used may have that sole function, or it may be multifunctional.

Multifunctional viscosity modifiers that also function as dispersants are also known and may be prepared as described above for dispersants. The oil soluble polymeric hydrocarbon backbone will usually have a $\overline{M}n$ of from 20,000, more typically from 20,000 up to 500,000 or greater. In general, these dispersant viscosity modifiers are functionalized polymers (e.g., inter polymers of ethylene-propylene post grafted with an active monomer such as maleic anhydride) which are then derivatized with, for example, an alcohol or amine.

Suitable compounds for use as monofunctional viscosity modifiers are generally high molecular weight hydrocarbon polymers, including polyesters. Oil soluble viscosity modifying polymers generally have weight average molecular weights of from about 10,000 to 1,000,000, preferably 20,000 to 500,000, which may be determined by gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979) or by light scattering.

Representative examples of suitable viscosity modifiers are polybutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

The viscosity modifier used in the invention will be used in an amount to give the required viscosity characteristics. Since viscosity modifiers are often added to blends in the form of oil solutions the amount of additive employed will depend on the concentration of polymer in the oil solution comprising the additive. However by way of illustration, typical oil solutions of polymer used as viscosity modifiers are used in amount of from 1 to 30% of the blended oil. The amount of viscosity modifier as active ingredient of the oil is generally from 0.01 to 6 wt. %, and more preferably from 0.1 to 2 wt. %.

OTHER DETERGENT INHIBITOR PACKAGE ADDITIVES

Additional additives are typically incorporated into the compositions of the present invention. Examples of such additives are dispersants, metal or ash-containing detergents, antioxidants, anti-wear agents, friction modifiers, corrosion inhibitors, rust inhibitors, anti-foaming agents, demulsifiers, and pour point depressants.

The dispersant comprises an oil solublizing polymeric hydrocarbon backbone having functional groups that are capable of associating with particles to be dispersed. Typically, the dispersants comprise amine, alcohol, amide, or ester polar moieties attached to the polymer backbone often via a bridging group. The dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone is typically an olefin polymer, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene and butylene or copolymers of two different alpha-olefins). Other copolymers include those in which a minor molar amount of the copolymer monomers, e.g., 1 to 10 mole %, is a $C_3$ to $C_{22}$ non-conjugated diolefin (e.g., a copolymer of isobutylene and butadiene, or a copolymer of ethylene, propylene and 1,4-hexadiene or 5-ethylidene-2-norbornene).

One preferred class of olefin polymers is polybutenes and specifically polyisobutenes (PIB) or poly-n-butenes, such as may be prepared by polymerization of a $C_4$ refinery stream. Another preferred class of olefin polymers is ethylene alpha-olefin (EAO) copolymers or alpha-olefin homo- and copolymers having in each case a high degree (e.g., >30%) of terminal vinylidene unsaturation. That is, the polymer has the following structure:

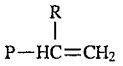

wherein P is the polymer chain and R is a $C_1$–$C_{18}$ alkyl group, typically methyl or ethyl. Preferably the polymers have at least 50% of the polymer chains with terminal vinylidene unsaturation. EAO copolymers of this type preferably contain 1 to 50 wt. % ethylene, and more preferably 5 to 45 wt. % ethylene. Such polymers may contain more than one alpha-olefin and may contain one or more $C_3$ to $C_{22}$ diolefins. Also usable are mixtures of EAO's of low ethylene content with EAO's of high ethylene content. The EAO's may also be mixed or blended with PIB's of various $\overline{M}n$'s or components derived from these may be mixed or blended. Atactic propylene oligomer typically having $\overline{M}n$ of from 700 to 500 may also be used, as described in EP-A-490454.

Suitable olefin polymers and copolymers may be prepared by cationic polymerization of hydrocarbon feedstreams, usually $C_3$–$C_5$, in the presence of a strong Lewis acid catalyst and a reaction promoter, usually an organoaluminum such as HCl or ethylaluminum dichloride. Tubular or stirred reactors may be used. Such polymerizations and catalysts are described, e.g., in U.S. Pat. Nos. 4,935,576 and 4,952,739. Fixed bed catalyst systems may also be used as in U.S. Pat. No. 4,982,045 and UK-A 2,001,662. Most commonly, polyisobutylene polymers are derived from Raffinate I refinery feedstreams. Conventional Ziegler-Natta polymerization may also be employed to provide olefin polymers suitable for use to prepare dispersants and other additives.

The polymers may be prepared by polymerizing the appropriate monomers in the presence of a catalyst system comprising at least one metallocene (e.g., a cyclopentadienyl-transition metal compound) and preferably an activator, e.g., an alumoxane compound. The metallocenes may be formed with one, two, or more cyclopentadienyl groups, which are substituted or unsubstituted. The metal locene may also contain a further displaceable ligand, preferably displaced by a cocatalyst—a leaving group—that is usually selected from a wide variety of hydrocarbyl groups and halogens. Optionally there is a bridge between the cyclopentadienyl groups and/or leaving group and/or transition metal, which may comprise one or more of a carbon, germanium, silicon, phosphorus or nitrogen atom-containing radical. The transition metal may be a Group IV, V or VI transition metal. Such polymerizations and catalysts are described, for example, in U.S. Pat. Nos. 4530914, 4665208, 4808561, 4871705, 4897455, 4937299, 4952716, 5017714, 5055438, 5057475, 5064802, 5096867, 5120867, 5124418, 5153157, 5198401, 5227440, 5241025; EP-A-129368, 277003, 277004, 420436, 520732; and WO-A-91/04257, 92/00333, 93/08199, 93/08221, 94/07928 and 94/13715.

The oil soluble polymeric hydrocarbon backbone will usually have number average molecular weight ($\overline{M}n$) within the range of from 300 to 20,000. The $\overline{M}n$ of the backbone is preferably within the range of 500 to 10,000, more preferably 700 to 5,000 where the use of the backbone is to prepare a component having the primary function of dispersancy. Hetero polymers such as polyepoxides are also usable to prepare components. Both relatively low molecular weight ($\overline{M}n$ 500 to 1500) and relatively high molecular weight ( $\overline{M}n$ 1500 to 5,000 or greater) polymers are useful to make dispersants. Particularly useful olefin polymers for use in dispersants have $\overline{M}N$, within the range of from 1500 to 3000. Where the component is also intended to have a viscosity modification effect it is desirable to use higher molecular weight, typically with $\overline{M}n$ of from 2,000 to 20,000, and if the component is intended to function primarily as a viscosity modifier then the molecular weight may be even higher with an $\overline{M}n$ of from 20,000 up to 500,000 or greater. The functionalized olefin polymers used to prepare dispersants preferably have approximately one terminal double bond per polymer chain.

The $\overline{M}n$ for such polymers can be determined by several known techniques. A convenient method for such determination is by gel permeation chromatography (described above).

The oil soluble polymeric hydrocarbon backbone may be functionalized to incorporate a functional group into the backbone of the polymer, or as one or more groups pendant from the polymer backbone. The functional group typically will be polar and contain one or more hetero atoms such as P, O, S, N, halogen, or boron. It can be attached to a saturated hydrocarbon part of the oil soluble polymeric hydrocarbon backbone via substitution reactions or to an olefinic portion via addition or cycloaddition reactions. Alternatively, the functional group can be incorporated into the polymer in conjunction with oxidation or cleavage of the polymer chain end (e.g., as in ozonolysis).

Useful functionalization reactions include: halogenation of the polymer at an olefinic bond and subsequent reaction of the halogenated polymer with an ethylenically unsaturated functional compound; reaction of the polymer with an unsaturated functional compound by the "ene" reaction absent halogenation (e.g., maleation where the polymer is reacted with maleic acid or anhydride); reaction of the polymer with at least one phenol group (this permits derivatization in a Mannich base-type condensation); reaction of the polymer at a point of unsaturation with carbon monoxide using a Koch-type reaction to introduce a carbonyl group in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil soluble polymeric hydrocarbon backbone is then further derivatized with a nucleophilic reactant such as an amine, amino-alcohol, alcohol, metal compound or mixture thereof to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g., polyalkylene and polyoxyalkylene polyamines of about 2 to 60, conveniently 2 to 40 (e.g., 3 to 20), total carbon atoms and about 1 to 12, conveniently 3 to 12, and preferably 3 to 9 nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine.

Other useful amine compounds include: alicyclic diamines such as 1,4-di(aminomethyl) cyclohexane, and heterocyclic nitrogen compounds such as imidazolines. A particularly useful class of amines are the polyamido and related amido-amines as disclosed in U.S. Pat. Nos. 4,857,217; 4,956,107; 4,963,275; and 5,229,022. Also usable is tris(hydroxymethyl) amino methane (THAM) as described in U.S. Pat. Nos. 4,102,798; 4,113,639; 4,116,876; and UK 989,409. Dendrimers, star-like amines, and comb-structure amines may also be used. Similarly, one may use the condensed amines disclosed in U.S. Pat. No. 5,053,152. The functionalized polymer is reacted with the amine compound according to conventional techniques as described in EP-A 208,560; U.S. Pat. No. 4,234,435 and U.S. Pat. No. 5,229,022.

The functionalized oil soluble polymeric hydrocarbon backbones also may be derivatized with hydroxy compounds such as monohydric and polyhydric alcohols or with aromatic compounds such as phenols and naphthols. Polyhydric alcohols are preferred, e.g., alkylene glycols in which the alkylene radical contains from 2 to 8 carbon atoms. Other useful polyhydric alcohols include glycerol, monooleate of glycerol, monostearate of glycerol, monomethyl ether of glycerol, pentaerythritol, dipentaerythritol, and mixtures thereof. An ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding dispersants comprise the ether-alcohols and including, for example, the oxy-alkylene, oxy-arylene. They are exemplified by ether-alcohols having up to 150 oxy-alkylene radicals in which the alkylene radical contains from 1 to 8 carbon atoms. The ester dispersants may be di-esters of succinic acids or acidic esters, i.e., partially esterified succinic acids; as well as partially esterified polyhydric alcohols or phenols, i.e., esters having free alcohols or phenolic hydroxyl radicals. An ester dispersant may be prepared by one of several known methods as illustrated, for example, in U.S. Pat. No. 3,381,022.

A preferred group of dispersants includes those substituted with succinic anhydride groups and reacted with polyethylene amines (e.g., tetraethylene pentamine), aminoalcohols such as trismethylolaminomethane and optionally additional reactants such as alcohols and reactive metals e.g., pentaerythritol, and combinations thereof). Also useful are dispersants wherein a polyamine is attached directly to the backbone by the methods shown in U.S. Pat. Nos. 3,275,554 and 3,565,804 where a halogen group on a halogenated hydrocarbon is displaced with various alkylene polyamines.

Another class of dispersants comprises Mannich base condensation products. Generally, these are prepared by condensing about one mole of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a long chain, high molecular weight hydrocarbon (e.g., $\overline{M}n$ of 1,500 or greater) on the benzene group or may be reacted with a compound containing such a hydrocarbon, for example, polyalkenyl succinic anhydride as shown in U.S. Pat. No. 3,442,808.

Examples of dispersants prepared from polymers prepared from metallocene catalysts and then functionalized, derivatized, or functionalized and derivatized are described in the patents listed.

The functionalizations, derivatizations, and post-treatments described in the following patents may also be adapted to functionalize and/or derivatize the preferred polymers described above: U.S. Pat. Nos. 3,275,554, 3,565,804, 3,442,808, 3,442,808, 3,087,936 and 3,254,025.

The dispersant can be further post-treated by a variety of conventional post treatments such as boration, as generally taught in U.S. Pat. Nos. 3,087,936 and 3,254,025. This is readily accomplished by treating an acyl nitrogen-containing dispersant with a boron compound selected from the group consisting of boron oxide, boron halides, boron acids and esters of boron acids, in an amount to provide from about 0.1 atomic proportion of boron for each mole of the acylated nitrogen composition to about 20 atomic proportions of boron for each atomic proportion of nitrogen of the acylated nitrogen composition. Usefully the dispersants contain from about 0.05 to 2.0 wt. %, e.g., 0.05 to 0.7 wt. % boron based on the total weight of the borated acyl nitrogen compound. The boron, which appears be in the product as dehydrated boric acid polymers (primarily $(HBO_2)3$), is believed to attach to the dispersant imides and diimides as amine salts e.g., the metaborate salt of the diimide. Boration is readily carried out by adding from about 0.05 to 4, e.g., 1 to 3 wt. % (based on the weight of acyl nitrogen compound) of a boron compound, preferably boric acid, usually as a slurry, to the acyl nitrogen compound and heating with stirring at from 135° to 190° C., e.g., 140°–170° C., for from 1 to 5 hours followed by nitrogen stripping. Alternatively, the boron treatment can be carried out by adding boric acid to a hot reaction mixture of the dicarboxylic acid material and amine while removing water.

Metal-containing or ash-forming detergents other than the calcium detergents described above may be used. These non calcium detergents used include oil-soluble neutral and overbased sulfonates, phenates, sulfurized phenates, thiophosphonates, salicylates, naphthenates and other oil-soluble carboxylates of a metal, particularly the alkali or alkaline earth metals other than calcium, e.g., sodium, potassium, lithium, and magnesium. The most commonly used metal is magnesium, which may both be present in detergents used in a lubricant, and mixtures of magnesium with sodium. Particularly convenient metal detergents are neutral and overbased magnesium sulfonates having TBN of from 20 to 450 TBN. The non-calcium detergents may be prepared by method analogous to those described above for calcium.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates are oil soluble salts of dihydrocarbyl dithiophosphoric acids and may be represented by the following formula:

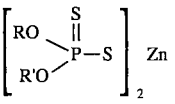

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e., R and R') in the dithiophosphoric acid will generally be about 5 or greater. The zinc dihydrocarbyl dithiophosphate can therefore comprise zinc dialkyl dithiophosphates. Conveniently at least 50 (mole) % of the alcohols used to introduce hydrocarbyl groups into the dithiophosphoric acids are secondary alcohols.

Oxidation inhibitors or antioxidants reduce the tendency of mineral oils to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons, phosphorous esters, metal thiocarbamates, oil soluble aromatic amines having at least two aromatic groups attached directly to one amine nitrogen, oil soluble copper compounds as described in U.S. Pat. No. 4,867,890, and molybdenum containing compounds.

Friction modifiers may be included to improve fuel economy. Oil-soluble alkoxylated mono- and diamines are well known to improve boundary layer lubrication. The amines may be used as such or in the form of an adduct or reaction product with a boron compound such as a boric oxide, boron halide, metaborate, boric acid or a mono-, di- or trialkyl borate.

Other friction modifiers are known. Among these are esters formed by reacting carboxylic acids and anhydrides with alkanols. Other conventional friction modifiers generally consist of a polar terminal group (e.g., carboxyl or hydroxyl) covalently bonded to an oleophilic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No. 1,560,830. Benzotriazoles derivatives also fall within this class of additives.

A small amount of a demulsifying component may be used. A preferred demulsifying component is described in EP 330,522. It is obtained by reacting an alkylene oxide with an adduct obtained by reacting a bis-epoxide with a polyhydric alcohol.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

When lubricating compositions contain one or more of the above-mentioned additives, each additive is typically blended into the base oil in an amount that enables the additive to provide its desired function. Representative effective amounts of such additives, when used in crankcase lubricants, are listed below. All the values listed are stated as mass percent active ingredient.

| ADDITIVE | MASS % (Broad) | MASS % (Preferred) |
|---|---|---|
| Ashless Dispersant | 0.1–20 | 1–8 |
| Metal detergents | 0.1–15 | 0.2–9 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Viscosity Modifier | 0.01–6 | 0–4 |
| Mineral or Synthetic Base Oil | Balance | Balance |

The components may be incorporated into a base oil in any convenient way. Thus, each of the components can be added directly to the oil by dispersing or dissolving it in the oil at the desired level of concentration. Such blending may occur at ambient temperature or at an elevated temperature.

Preferably all the additives except for the viscosity modifier and the pour point depressant are blended into a concentrate or additive package, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

Preferably the concentrate is made in accordance with the method described in U.S. Pat. No. 4,938,880. That patent describes making a premix of dispersant and metal detergents that is pre-blended at a temperature of at least about 100° C. Thereafter the pre-mix is cooled to at least 85° C. and the additional components are added.

The final formulations may employ from 2 to 15 mass % and preferably 5 to 10 mass %, typically about 7 to 8 mass % of the concentrate or additive package with the remainder being base oil.

The invention will now be described by way of illustration only with reference to the following examples. In the examples, unless otherwise noted, all treat rates of all additives are reported as mass percent active ingredient.

Examples 1 to 2 and Comparative Examples A to G

Experimental SAE 5W-30 lubricants are made by adding to a basestock dispersant, zinc dialkldithiophosphate, antioxidant, demulsifier, antifoamant, olefin copolymer viscosity modifier and a detergent system. The detergents systems varied amounts and types of calcium salts of organic acid used. Table I shows the detergents systems, the CCS, and the Noack volatility. The comparative examples demonstrate the need to use a basestock having an average basestock neutral number of at least 105 to meet requirements for both the low temperature viscosity and Noack volatility. Comparative Examples B through G demonstrate the how calcium salts of organic acids adversely effect performance.

| Oil No. | 1 | 2 | A | B | C | D | E | F | G |
|---|---|---|---|---|---|---|---|---|---|
| Mg Sulphonate, 400 TBN | 0.69 | 0 | 0.69 | 0.69 | 0.69 | 0.69 | 0.69 | 0 | 0.69 |
| Mg Salicylate, 345 TBN | 0 | 0.72 | 0 | 0 | 0 | 0 | 0 | 0.72 | 0 |
| Ca Phenate, 125 TBN | 0 | 0 | 0 | .45 | 0.9 | 0 | 0 | 0.9 | 0 |
| Ca Sulphonate, 24 TBN | 0 | 0 | 0 | 0 | 0 | 0 | 0 | 0 | 0.9 |
| Ca Salicylate, 64 TBN | 0 | 0 | 0 | 0 | 0 | 0.65 | 1.3 | 0 | 0 |
| Av BSN | 106.1 | 105.1 | 100.0 | 106.2 | 106.3 | 106.2 | 106.3 | 106.3 | 105.0 |
| kV 100 C. | 10.2 | 10.1 | 9.8 | 10.2 | 10.3 | 10.2 | 10.3 | 10.3 | 10.4 |
| CCS −25 C. | 3410 | 3380 | 3030 | 3610 | 3760 | 3510 | 3570 | 3740 | 3650 |
| Noack Volatility | 21.8 | 22.5 | 22.8 | 22.2 | 22.2 | 22.7 | 22.1 | 22.7 | 22.0 |
| moles Ca Salt/100 gm lubricant | 0 | 0 | 0.00000 | 0.00083 | 0.00167 | 0.00085 | 0.00170 | 0.00167 | 0.00096 |

What is claimed is:

1. An SAE 5W multigrade lubricant comprising basestock, viscosity modifier, and at least one additive selected from the group consisting of dispersants, overbased and neutral salts of organic acids, corrosion inhibitors, antiwear agents, antioxidants, friction modifiers, antifoamants, and demulsifiers wherein the basestock has an average base stock neutral number of at least 105 and comprises less than 5 wt. % non conventional lubricant, and the lubricant has a maximum CCS viscosity of $3500\times10^{-3}$ Pa.s at −25° C., a calibrated Noack volatility of not more than 22 wt. % loss, and a kinematic viscosity at 100° C. measured by ASTM D445 not greater than 12.5 cSt and contains no more than 0.0007 moles of calcium salts of organic acids per 100 grams of lubricant.

2. The lubricant of claim 1 wherein the calcium salt of an organic acid is present as a neutral salt having a TBN less than about 75.

3. The lubricant of claim 1 wherein the calcium salt of an organic acid is present as an overbased salt having a TBN of at least about 235.

4. The lubricant of claim 1 wherein the calcium salt of an organic acid is present as an overbased sulfonate having a TBN of at least about 300.

5. The lubricant of claim 1 wherein an overbased salt of an organic acid is present and is a magnesium sulfonate having a TBN of at least about 400.

6. The lubricant of claim 1 wherein the calcium salt of an organic acid is a neutral calcium sulfonate, phenate, salicylate or mixture thereof having a TBN less than about 75 and is present at a level of at least 0.0004 moles of calcium salt.

7. The lubricant of claim 6 wherein the calcium salt is a calcium phenate or a calcium salycilate.

8. The lubricant of claim 1 wherein any calcium salt present is present at a level not exceeding about 0.0012 moles per 100 g lubricant.

9. The lubricant of claim 1 wherein the viscosity modifier is mono-functional.

* * * * *